US005865479A

United States Patent [19]

Viney

[11] Patent Number: 5,865,479

[45] Date of Patent: Feb. 2, 1999

[54] LOCK MECHANISM

[75] Inventor: Bernard John Viney, Wokingham, United Kingdom

[73] Assignee: Surelock McGill Limited, Berkshire, United Kingdom

[21] Appl. No.: 436,558

[22] Filed: May 8, 1995

[30] Foreign Application Priority Data

May 6, 1994 [GB] United Kingdom ..... 9408989

[51] Int. Cl.[6] ..... E05C 1/06

[52] U.S. Cl. ..... 292/39; 70/111; 70/DIG. 42

[58] Field of Search ..... 292/39, 150, DIG. 65, 292/22, 92, 153, DIG. 26; 70/107, 108, 109, 111, 118, 120, 190, DIG. 42, 110, 142, 473, 474, 477, 479, 484

[56] References Cited

U.S. PATENT DOCUMENTS

| | | | |
|---|---|---|---|
| 430,072 | 6/1890 | Dowd | 70/120 |
| 1,152,776 | 9/1915 | Wolfe | 70/118 |
| 1,179,731 | 4/1916 | McDonald | 292/150 |
| 2,125,227 | 7/1938 | Hammarle | 70/118 |
| 3,792,885 | 2/1974 | Giardina et al. | 292/39 |
| 5,083,448 | 1/1992 | Kärkkäinen et al. | 70/277 |
| 5,245,846 | 9/1993 | James | 70/118 |
| 5,290,077 | 3/1994 | Fleming | 292/35 |
| 5,524,941 | 6/1996 | Fleming | 292/34 |
| 5,531,493 | 7/1996 | Reynolds | 292/32 |

FOREIGN PATENT DOCUMENTS

| | | |
|---|---|---|
| 669 066 | 3/1952 | United Kingdom . |
| 1 021 089 | 2/1966 | United Kingdom . |
| 1 363 050 | 8/1974 | United Kingdom . |

OTHER PUBLICATIONS

Brochure of Surelock McGill Ltd., published 1991, p. 1.31.1.

"Multiple Bolting Systems for Self Locking Doors", SM Surelock McGill Ltd., 1 sheet (Published 1991).

*Primary Examiner*—Steven N. Meyers
*Assistant Examiner*—Gary Estremsky
*Attorney, Agent, or Firm*—Westman, Champlin & Kelly, P.A.

[57] ABSTRACT

A lock mechanism comprises at least one bolt member moveable between an engaged and a disengaged position. The latch arrangement prevents movement of the bolt members from the engaged position to the disengaged position. A first operating member for operating the lock mechanism is provided on one side thereof and a second operating member and a latch release arrangement are provided on the other side of the lock mechanism. The latch arrangement responds to movement of the first operating member or the latch release arrangement to release the bolt members and allow movement thereof from the engaged position to the disengaged position. The bolt members are further moveable between the engaged and disengaged positions in response to movement of the first or second operating members.

24 Claims, 6 Drawing Sheets

A
210
205
207
211
206
C
204
208
212
20
B
70a
8
70
3
3a
3b
60
10
60a
60b
9
203
4
A

LOCK MECHANISM

BACKGROUND OF THE INVENTION

The present invention relates to a lock mechanism and more particularly to a lock mechanism which can be latched in an engaged position.

Locks which provide security on one side and easy and quick operation from the other aide are used widely, particularly for doors providing an emergency exit from a building.

Commonly such locks use an engineered rack and pinion operating mechanism to operate several strong bolts simultaneously to secure the door. The door is thus secured at various points around its perimeter to provide security and prevent access from one side of the door. When such a door is an emergency exit it is necessary to comply with safety requirements to provide an operating lever inside which will operate by a single simple movement to retract the bolts and unlock the door to allow a safe and quick exit through the door from the building. Typically, a horizontal bar is provided on such doors for the operation of the lock mechanism.

Thus for lock mechanisms used for such doors there are conflicting requirements. One requirement is the security to prevent access from one side whilst the other requirement is a safety requirement to provide for simple and quick operation of the lock mechanism from the inside to allow the door to be unlocked quickly in an emergency. Thus in one aspect the present invention is directed towards a solution to this problem.

The lock mechanisms currently available with a direct drive mechanism to the bolts such as a rack and pinion do not provide adequate security since they do not provide resistance to the application of pressure to the ends of the bolts. It is to this problem that a further aspect of the present invention is directed.

SUMMARY OF THE INVENTION

According to one aspect the present invention provides a lock mechanism comprising at least one bolt member moveable between an engaged and a disengaged position, latch means arranged to prevent movement of at least one said bolt member from said engaged position to said disengaged position, a first operating member for operating said lock mechanism from one side thereof, and operating means for operating said lock mechanism from the other side thereof, wherein said operating means comprises a second operating member and latch release means, said latch means is arranged to be responsive to movement of said first operating member or said latch release means to release said bolt member and allow movement thereof from an engaged position to a disengaged position, and said bolt members are arranged to be moveable between said engaged and disengaged positions in response to movement of said first or second operating members.

Preferably said bolt members are arranged to be directly driven between said engaged and disengaged positions by movement of said first or second operating members.

In another aspect the present invention provides a lock mechanism for use on a door hinged in a door frame at a first side, said lock mechanism comprising bolt members moveable between an engaged position in said door frame and a disengaged position, said bolt members being arranged to engage said door frame from at least two of the sides of said door which are not hinged, latch means arranged to prevent movement of at least one said bolt member from said engaged position to said disengaged position, and a latch release arrangement to disengage said latch means and allow movement of said at least one bolt member, said latch release arrangement and said at least one bolt means being arranged to being operable in response to a single movement of an operating member to allow said latch means to be disengaged and said bolt members to be disengaged from said engaged position; and said bolt members being arranged to be directly driven between said engaged and disengaged positions by movement of said operating member.

In such a lock mechanism there is preferably included a first operating member for operating to at least one bolt member and said latch release arrangement from one side of said lock mechansim, and operating means for operating said at least one bolt member and said latch release arrangement from the other side of said lock mechanism, said operating means comprising a second operating member and latch release means, said latch release means being arranged to operate said latch release arrangement, and said bolt means being arranged to be moveable between said engaged and said disengaged positions in response to movement of said first or second operating members.

The lock mechanism according to one embodiment of the present invention which utilises a direct drive mechanism between the operating member, e.g. a handle, and the bolt members provides for positive and visible locking since the position of the operating member will indicate whether the bolt members are properly engaged or not. Such a direct driven bolting arrangement provides for a heavy duty lock mechanism which together with the latching arrangement, which operates when the bolt members are engaged, provides for high security.

Preferably said latch means is arranged to be responsive to an initial movement of said first operating member and said bolt means may not be responsive to said initial movement of said first operating member.

In embodiments the latch release means can include key means and/or an electrically operated actuator which allows for remote operation of the latch means.

Preferably said latch means is arranged to engage said at least one bolt member.

In one embodiment said latch means comprises a first latch arrangement arranged to be responsive to movement of said first operating member to an unlatched state and release said bolt member and the second latch arrangement arranged to be responsive to said latch release means to move to an unlatched state and release said bolt member. In such an arrangement the first and second latch arrangements are preferably arranged to co-operatively prevent movement of said bolt member. Further, said latch means is preferably arranged to be disabled when said second latch arrangement is held in an unlatched state by said latch release means.

In order to ensure automatic locking of the lock mechanism preferably said second latch arrangement is biased such that it will assume a latched position unless acted upon by said latch release means. Further, in order to provide the usual spring resistance to the unlocking of the lock mechanism, the lock mechanism preferably includes bolt member bias means arranged to bias at least one bolt member towards an engaged position.

In one embodiment the lock mechanism includes bolt member drive means arranged to drive said at least one bolt member between said engaged and disengaged positions.

In such an embodiment the bolt member drive means preferably comprises a first drive gear wheel engaged with a length of a first bolt member and with a length of a first side of a second bolt member, a second drive gear wheel engaged with a length of a second side of said second bolt member with a length of a third bolt member, said first and second drive gear wheels being arranged to rotate in opposite directions in response to movement of said first or second operating members, said first and third bolt members being arranged to be driven in opposed directions by rotation of said drive gear wheels, and said second bolt member being arranged to be driven in a direction generally perpendicularly to said opposed directions. This arrangement of gears provides for a strong direct drive mechanism between the operating member and the bolt members.

In one embodiment said latch means include latch operating means arranged to be responsive to movement of said first operating member to release said at least one bolt member; said latch operating means comprising a latch gear wheel and a latch member, said latch gear wheel being arranged to be responsive to movement of said first operating member to release said latch member from engagement with said bolt member.

In another embodiment said latch means includes latch operating means arranged to be responsive to movement of said first operating member to release said at least one bolt member, said latch operating means comprising a latch gear wheel and a latch operating member, said latch gear wheel being engaged with a length of said latch operating member and being arranged to rotate in response to movement of said first operating member and drive said latch operating member in a first direction, said latch means including a latch member arranged to be moveable between a latched and an unlatched position, and said latch operating member being connected to said latch member such that movement of said latch operating member in said first direction causes said latch member to move from said latch to said unlatched position.

Preferably said latch gear wheel and said first drive gear wheel are arranged on a common shaft, said latch gear wheel being adapted to receive said first operating member and rotate in response to movement thereof, said first drive gear wheel and said latch gear wheel being connected by lost motion means such that initial motion of said first operating member causes rotation of said latch gear wheel only until the lost motion is taken up whereupon motion of said first operating member causes rotation of said first drive gear wheel.

Preferably said lost motion means comprises at least one pin protruding from one of said latch gear wheel and said first drive gear wheel, and at least one slot provided in the other of said first drive gear wheel or said latch gear wheel to receive said at least one pin.

Preferably a lock mechanism includes latch member bias means arranged to return said latch member to the latched position once the lost motion is given up. Conveniently said latch member bias means may comprise spring means interconnecting said first drive gear wheel and said latch gear wheel.

In one embodiment said latch release means includes a lock member arranged to be engageable with said bolt member, and a key operable mechanism for operating said lock member.

Preferably said latch release means includes an electrically operated actuator such as a solenoid or remote electrical operation of the latch means.

DESCRIPTION OF THE PREFERRED EMBODIMENTS

Figure 1:
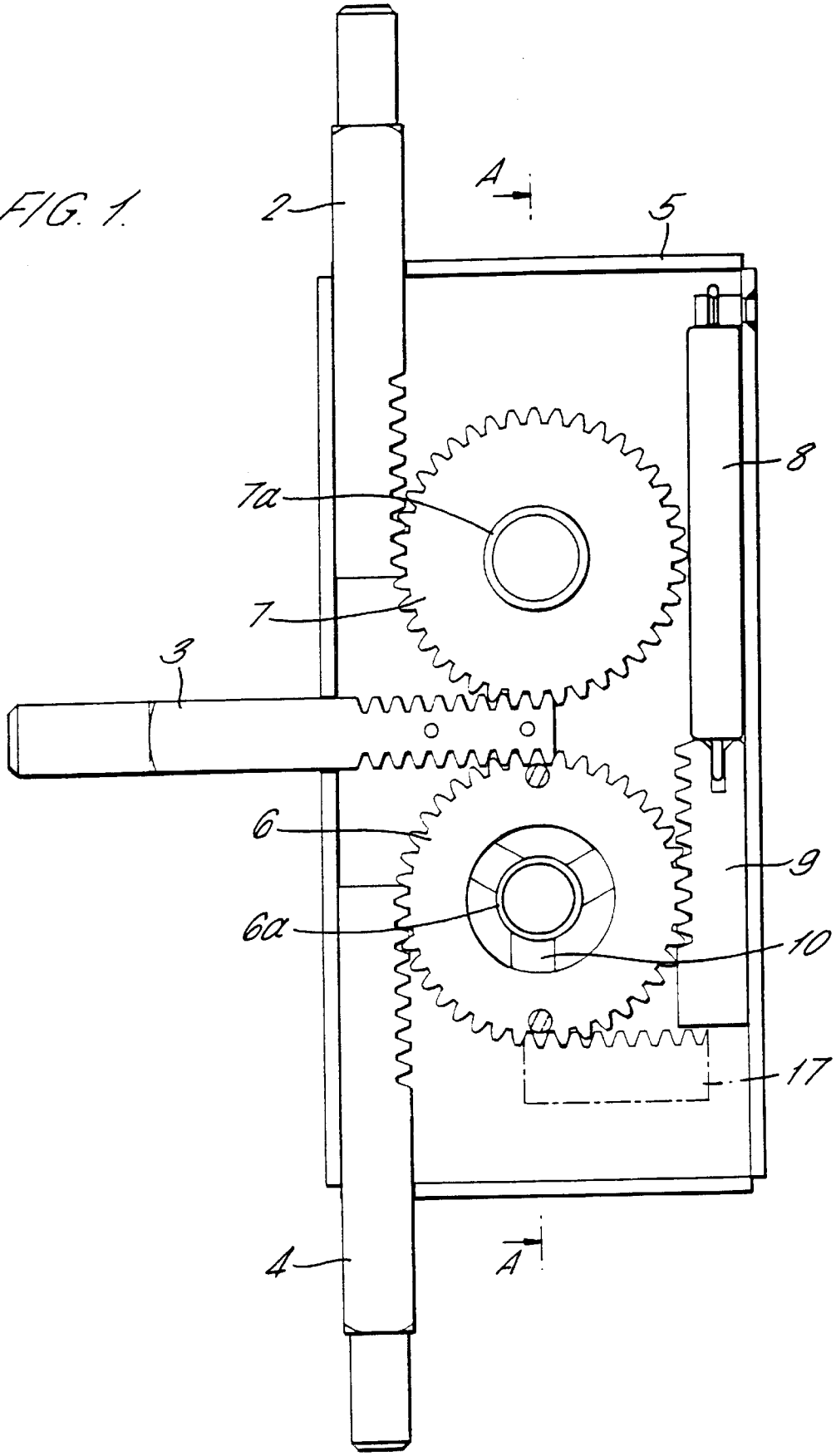
FIG. 1 is an elevation view of a lock mechanism according to one embodiment of the present invention with the cover plate removed.
Figure 2:
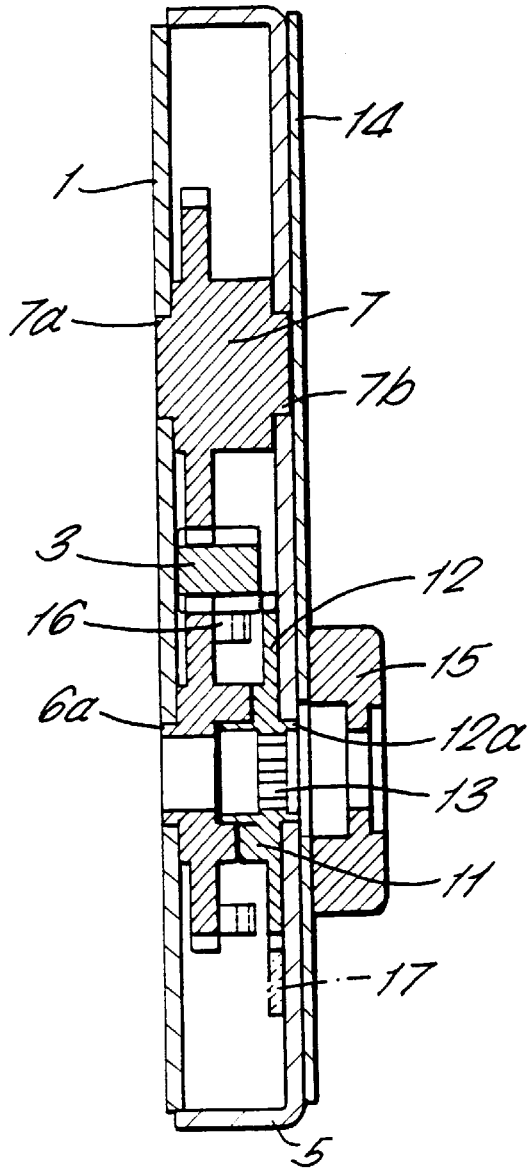
FIG. 2 is a cross-section A—A through FIG. 1.
Figure 3:
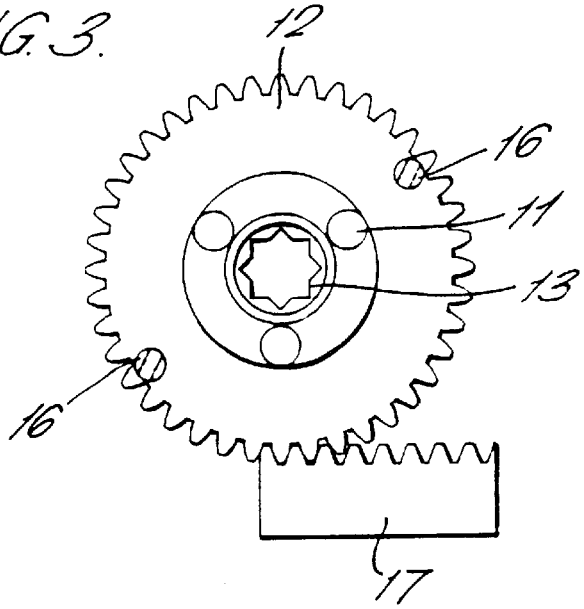
FIG. 3 is a view of the latch gear wheel and latch member according to one embodiment of the present invention.
Figure 4:
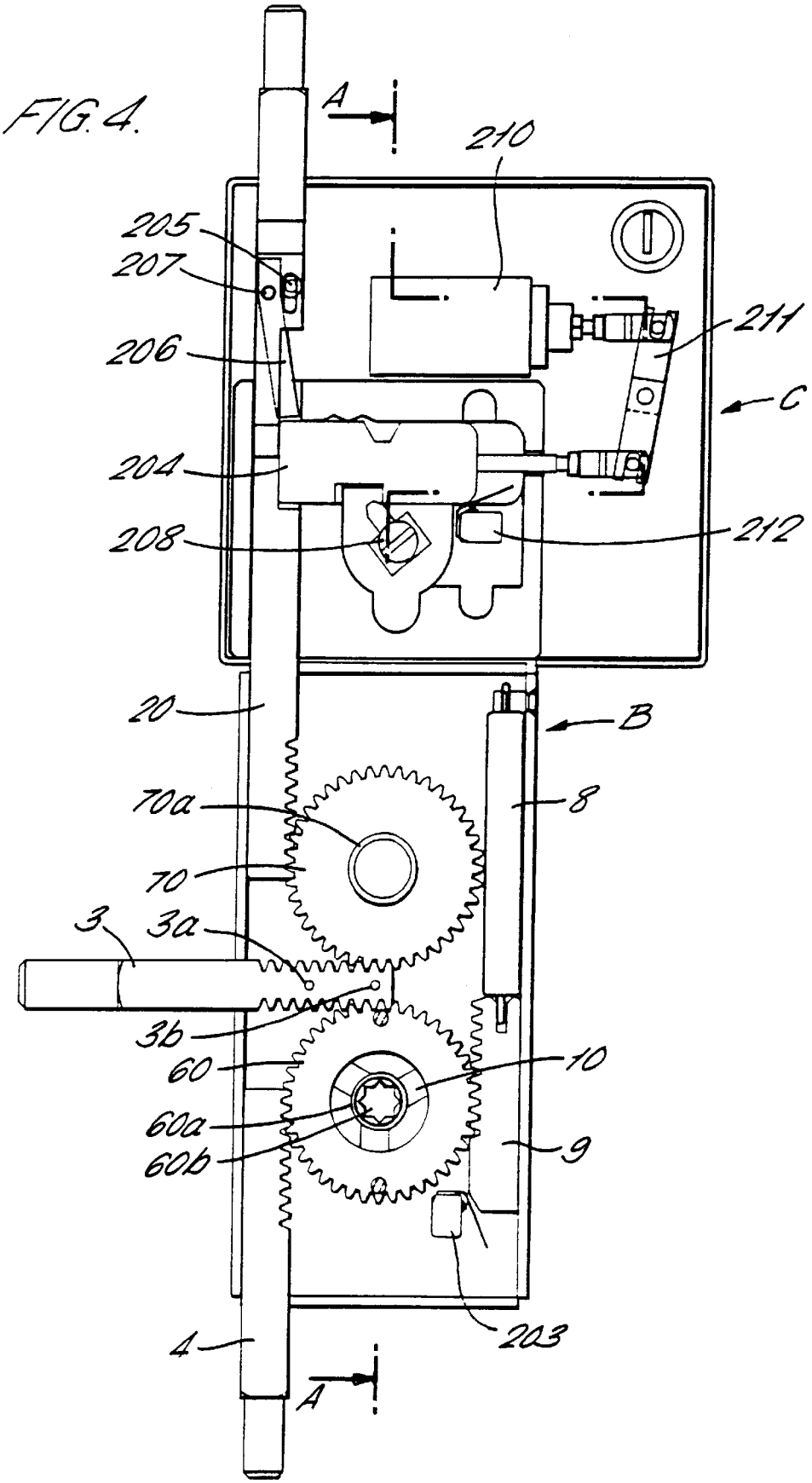
FIG. 4 is an elevation view of a lock mechaism according to a second embodiment of the present invention.

Referring now to the drawings, FIGS. 1, 2 and 3 illustrate one embodiment of the present invention which provides a lock mechanism which can be operated from one side using an operating member to unlatch the bolts when they are in the engaged position and to withdraw the bolts to a disengaged position. The release of the latch mechanism and the retraction of the bolts occurs by a single simple motion of the operating member.

This arrangement can be used for a door providing an emergency exit wherein an operating member is provided only on the inside of the door and no operating member is provided on the outside. Thus from the inside the lock mechanism can be operated simply and quickly by for instance a single push of a release bar, whilst on the outside the lock mechanism is not accessible. Thus from the outside the lock mechanism provides for security since not only is the lock mechanism inaccessible, but also the bolt members which engage the door frame are resistant to end pressure to retract them from the engaged position. Thus the simple lock mechanism provides the required security without compromising on the necessary safety element.

The specific construction of the lock mechanism will now be described with reference to FIGS. 1, 2 and 3.

In FIG. 1 the cover plate 1 which is shown in FIG. 2 is removed to show the construction of the lock mechanism in detail. Three bolt members 2, 3 and 4 project from the housing 5 and are capable of translational motion in and out of the housing 5. Two of the bolt members 2 and 4 move in opposite directions whilst the third bolt member 3 moves in a direction which is generally perpendicular to the opposed directions.

The bolt members 2, 3 and 4 are shown in FIG. 1 to have a fairly short length. However, the lengths of the bolt members 2, 3 and 4 will depend on the door to which the lock mechanism is designed to fit. Normally, the bolt members 2, 3 and 4 will be much longer and will be arranged to engage the top and bottom and one side of the door frame. The remaining side of the door frame is the side on which the door is hinged. Such an arrangement of bolts is a conventional method of providing security and provides a high resistance to a physical attack.

Within the housing 5 there is provided a first drive gear wheel 6 which has a portion 6*a* which fits into a hole in the cover 1 to allow rotation of the first drive gear wheel. Cogs of the first drive gear wheel engage cogs provided along one side of a length of the bolt members 3 and 4 which are arranged generally perpendicularly.

A second drive gear wheal 7 is provided space from the first drive gear wheel 6 and has a portion 7*a* which fits in a hole in the cover 1, a portion 7*b* which fits in a hole in a housing 5 to allow rotation of the second drive gear wheel 7. Cogs of the second drive gear wheel 7 are engaged with cogs provided along a length of the second side of the bolt member 3 and along a side of the bolt member 2. Thus the first and second drive gear wheels are arranged to rotate in opposite directions and the rotation thereof causes translational motion of the bolt members 2, 3 and 4.

The bolt members 2, 3 and 4 are biased in an engaged position by a spring 8 and a spring link member 9 which has cogs provided along a length to engage with the cogs of the first drive gear wheel 6.

The first drive gear wheel 6 is provided with offset slots 10 to receive pins 11 of a latch gear wheel 12. The latch gear wheel 12 has a portion 12*a* which fits into a hole in the housing 5 to allow rotation thereof. The first drive gear wheel 6 and the latch gear wheel 12 are mounted to have the same axis of rotation and support each other in the centre.

In the engaged position shown in FIG. 1 the pins 11 of the latch gear wheel 12 engage the slots 10 in the first drive gear wheel and reside at a position near the anticlockwise sides of the slots.

The latch gear wheel 12 is provided with a splined recess 13 which is designed to receive an operating member such as a handle for rotation of the latch gear wheel 12.

On the outside of the housing 5 there is provided a decorative plate 14 together with a rose plate 15 to support the handle and allow its rotation and operation of the lock mechanism.

The pins 11 of the latch gear wheel 12 are held in their position against the anticlockwise side of the slot 10 in the first drive gear wheel 6 by bias means provided in the form of springs 16 interconnecting the first drive gear wheel 6 and the latch gear wheel 12.

Cogs of the latch gear wheel 12 engage cogs provided on a latch member 17. In the engaged and latch position shown in FIG. 1 the latch member 17 has been extended to the right to prevent movement of the spring link member 9. Before the bolt members 2, 3 and 4 can be retracted to the disengaged position it is necessary to move the latch member 17 to the left to allow the spring link member 9 and hence the drive gear wheels 6 and 7 and the bolt members 2, 3 and 4 to move.

The movement of the latch member is achieved by rotation of the operating member and thus the rotation of the latch gear wheel 12. As the latch gear wheel rotates clockwise the latch gear wheel 17 is moved to the left. The pins 11 of latch gear wheel 12 move clockwise within the slots 10 of the first drive gear wheel until they make contact with the sides of the slots in the clockwise direction. When this occurs the latch member 17 has moved far enough left to be out of the way of the spring link member 9, i.e. it is in the unlatched position, and thus further rotation of the operating member causes the latch gear wheel 12 to drive the first drive gear wheel 6 in the clockwise direction against the spring force of the spring 8 to retract the bolt members 2, 3 and 4.

It can thus be seen that by rotation of an operating member inserted in the splined recess 13 of the latch gear wheel 12, by a single turning motion of the operating member the latch mechanism which holds the bolt members 2, 3 and 4 in the extended position is unlatched and the bolt members 2, 3 and 4 are retracted to release the lock mechanism. Thus during an initial rotation of an operating member the lost motion between the latch gear wheel 12 and the first drive gear wheel 6 is taken up against the biasing action of the spring means 16. Further rotation of the operating member will retract the bolt members 2, 3 and 4 against the biasing of the spring 8. Once the operating member is released the spring 8 will return the bolt members 2, 3 and 4 to the engaged position and as the operating member is further released to its original position the springs 16 will return the lost motion between the latch gear wheel and the first drive gear wheel.

The embodiment described hereinabove provides for a simple lock mechanism whereby no access is required to the mechanism from one side, i.e. outside. Such a lock mechanism can be used for a simple door forming an emergency exit.

FIGS. 4 to 7 illustrate a second embodiment of the present invention which provides the same simplistic single operation by an operating member on the one side but also allows for the operation of the lock mechanism from the other side. Operation of the lock from the other side is achieved using a second operating member together with a latch releasing means which will typically take the form of a key operated mechanism although an electrically operated mechanism can also be used.

As has been described hereinbefore, for a lock mechanism used on a door which comprises an emergency exit, it is necessary for a door to be openable from the inside by using a single simple action. This is provided for in the arrangement shown in FIGS. 4 to 7. To allow access from the outside, the lock mechanism also allows for the latch mechanism to be unlatched using either a key or by an electric actuator such as a solenoid, together with a second operating member to retract the bolt members. Thus a door fitted with a lock mechanism according to this embodiment of the present invention requires a latch release means such as a key operated lock to be operated first to disengage the latch and then a second operating member can be used to retract the bolt members.

The specific construction and operation of the embodiment illustrated in FIGS. 4 to 7 will now be described. The unit B has many components which are similar to those in the previous embodiment and thus like reference numerals have been used. In unit B the bolt members 3 and 4, the spring link member 9 and spring 8 are essentially unchanged from those shown in FIGS. 1 to 3. The first drive gear wheel 60 in FIGS. 4 and 5 differs from the first drive gear wheel shown in FIGS. 1 and 2 in that a splined recess 60*b* is provided to receive a second operating member which is inserted from the outside of a door to which the lock mechanism is fitted. The portion 60*a* of the first drive gear wheel 60 is inserted in the cover 100 in like manner to that shown in FIGS. 1 and 2.

The latch gear wheel 12 in the second embodiment is unchanged from what is shown in FIGS. 1 and 2. The latch gear wheel 12 and the first drive gear wheel 60 are inserted to rotate between a cover 100 and a housing 50 on the same axis and rotate with respect to each other in the centre.

Figure 5:
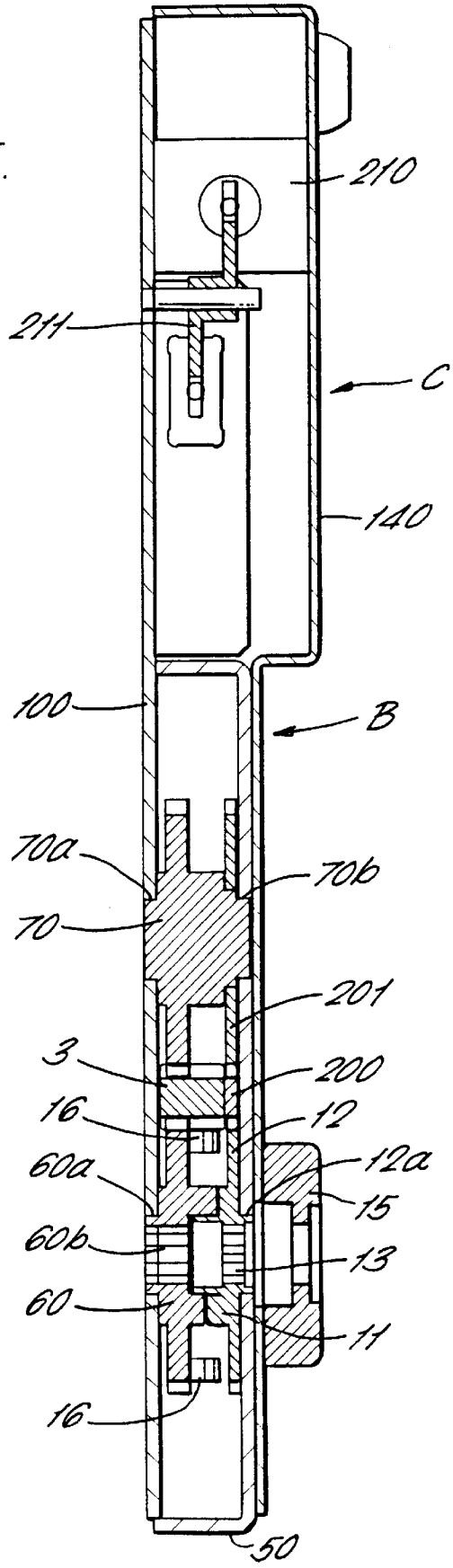
FIG. 5 is a cross-section A—A through FIG. 4.

As can be seen in FIG. 5, instead of the latch gear wheel 12 driving a latch member 17, in the second embodiment the latch gear wheel 12 drives a link member 200 which in turn drives a second latch gear wheel 201 which is mounted for rotation about the second drive gear wheel 70. In a similar manner to the first embodiment, the second drive gear wheel 70 has portions 70*a* and 70*b* mounted in holes in the cover 100 and housing 50 respectively to allow rotation of the second drive gear wheel 70.

Figure 6:
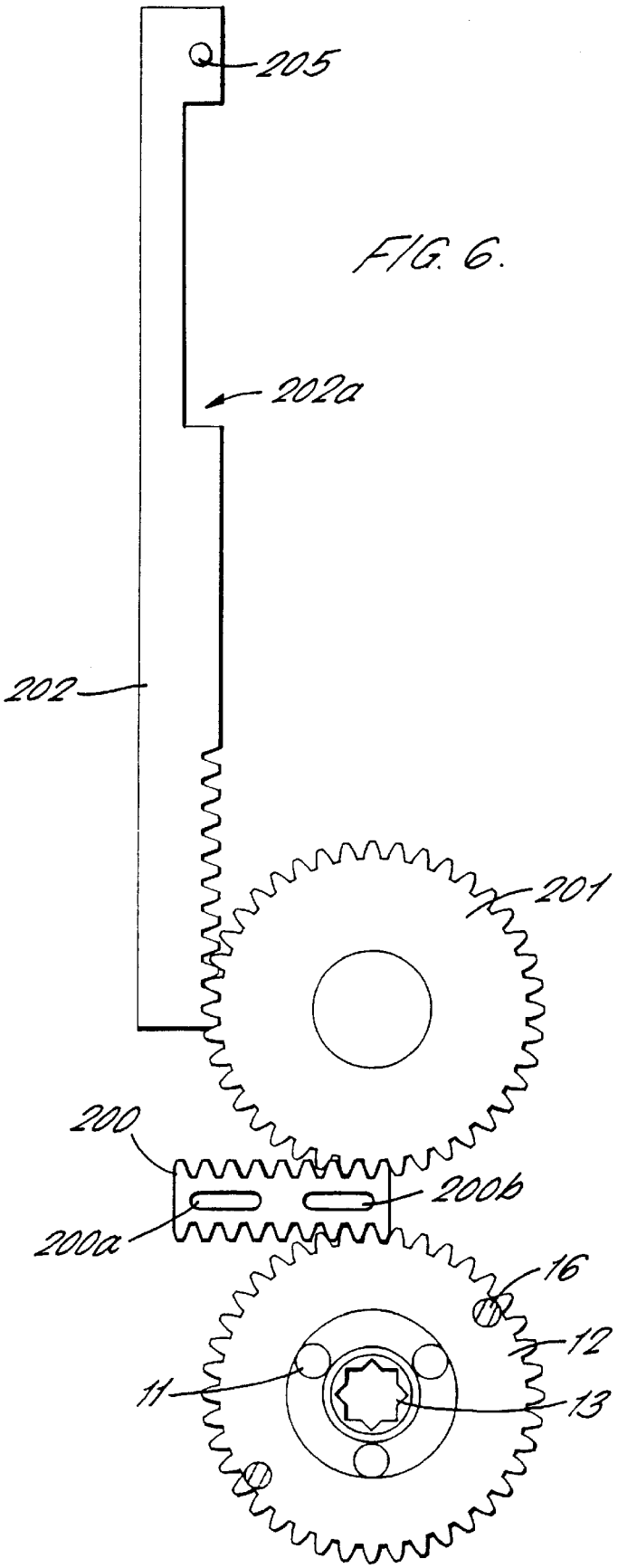
FIG. 6 is a view of the latch operating arrangement.
Figure 7:
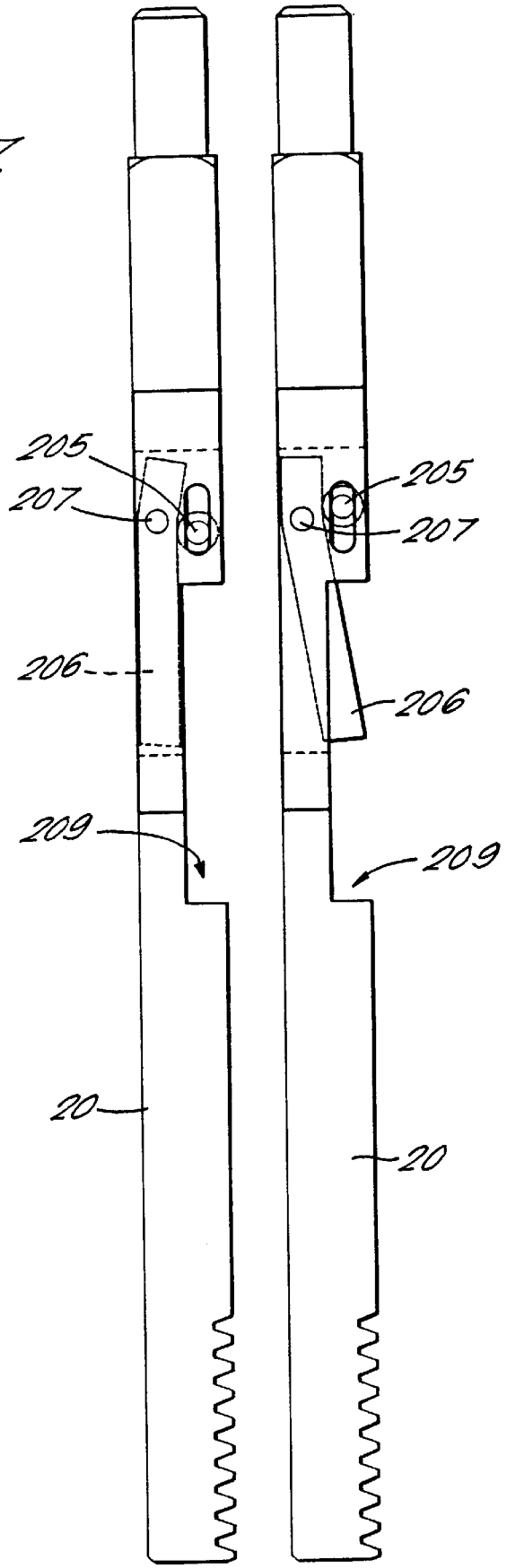
FIG. 7 is a view of a bolt member incorporating the latch member and is shown in a latched and unlatched state.

As can been seen in FIG. 6, the link member 200 has slots 200*a* and 200*b* and is mounted on the bolt member 3 such that pegs 3*a* and 3*b* of bolt member 3 protrude into the respective slots 200*a* and 200*b*. The pegs 3*a* and 3*b* hold the link member 200 in place and allow for relative translational motion between the bolt member 3 and the link member 200.

It can clearly be seen from FIG. 6 that rotation of the first latch gear wheel 12 by the insertion of a first operating member in the splined recess 13, is translated into rotational movement in the opposite direction of the second latch gear wheel 201 which in turn engages with a latch operating member 202 which is driven translationally. The latch operating member 202 has a recess 202*a* therein to avoid contact with the lock mechanism 204 within the unit C. At the end of the latch operating member 202 there is provided a pin 205 to operate the latch member 206.

Thus the latch arrangement operates in a similar manner to the latch arrangement in the first embodiment. When the first operating member rotates the first latch gear wheel 12, the lost motion provided by the pins 11 and slots 10 allows movement to be transmitted to the latch operating member 202 which causes the pin 205 to move down and thus push the latch member 206 to rotate about a pin 207. With the latch member unlatched the bolt member 20 is now free to be retracted by further rotation of the first operating member.

So far the unit C has not been discussed in detail and it is this unit which allows for access from outside through a door fitted with the lock arrangement of this embodiment of the present invention. Within the unit C there is provided a lock 204 which is operated by a lock operating mechanism 208 to allow the lock to be retracted from a recess 209 provided within the bolt member 20. Once the lock 204 is retracted from within the recess 209 the bolt member 20 is free to move translationally irrespective of the position of the latch member 206.

Within the unit C there is also provided a solenoid 210 which operates through a linkage 211 to act on the lock 204. Thus the solenoid 210 provides for the remote operation of the lock 204. This effectively allows for the remote disabling of the latch mechanism of the lock mechanism of this embodiment.

Since the unit C is provided with both the solenoid 210 and the lock operating mechanism 208, the lock mechanism of this embodiment can be operated from the outside by firstly either activation of the solenoid or turning of the lock operating mechanism 208 to withdraw the lock 204 from the recess 209, and then a second operating member inserted in the splined recess 60*a* can be turned to retract the bolt members 20, 3 and 4.

The lock 204 can be spring biased in order to ensure that the lock mechanism is self-locking once the bolt member 20 is moved to the engaged position. Also, the lock 204 can be any standard type of lock.

The lock 204 can be provided with a microswitch 212 to monitor the lock status. Further, the spring link member 9 can be provided with a second microswitch 203 to monitor the bolt status. For complete security, the door to which the lock mechanism is fitted should also be fitted with a microswitch so that the door status can be monitored. This allows for remote monitoring of the status of the lock mechanism and the door to which it is fitted and the provision of a solenoid 210 provides for the remote enabling and disabling of the latch mechanism so that the lock mechanism will operate in a standard way when the latch mechanism is disabled.

I claim:

1. A lock mechanism comprising at least one bolt member moveable between an engaged and a disengaged position, latch means arranged to prevent movement of at least one said bolt member from said engaged position to said disengaged position, a first operating member for operating said lock mechanism from one side thereof, and operating means for operating said lock mechanism from the other side thereof, wherein said operating means comprises a second operating member and latch release means, said latch means is arranged to be responsive to movement of said first operating member or said latch release means to release said bolt member and allow movement from an engaged to a disengaged position, and said at least one bolt member is arranged to be moveable between said engaged and disengaged positions in response to movement of said first or second operating members.

2. A lock mechanism as claimed in claim 1 wherein said at least one bolt member is arranged to be directly driven between said engaged and disengaged positions by movement of said first or second operating members.

3. A lock mechanism as claimed in claim 1 wherein said latch means is arranged to be responsive to an initial movement of said first operating member.

4. A lock mechanism as claimed in claim 3 wherein said at least one bolt member is not responsive to said initial movement of said first operating member.

5. A lock mechanism as claimed in claim 1 wherein said latch release means comprises key means.

6. A lock mechanism as claimed in claim 1 including an electrically operated actuator for remote operation of said latch means.

7. A lock mechanism as claimed in claim 6 wherein said latch release means includes said electrically operated actuator.

8. A lock mechanism as claimed in claim 1 wherein said latch means is arranged to engage said at least one bolt member.

9. A lock mechanism as claimed in claim 8 wherein said latch means comprises a first latch arrangement arranged to be responsive to movement of said first operating member to move to an unlatched state and release said at least one bolt member and a second latch arrangement arranged to be responsive to said latch release means to move to an unlatched state and release said at least one bolt member.

10. A lock mechanism as claimed in claim 9 wherein said first and second latch arrangements are arranged to co-operatively prevent movement of said at least one bolt member.

11. A lock mechanism as claimed in claim 10 wherein said latch means is arranged to be disabled when said second latch arrangement is held in an unlatched state by said latch release means.

12. A lock mechanism as claimed in claim 9 wherein said second latch arrangement is biased such that it will assume a latched position unless acted upon by said latch release means.

13. A lock mechanism as claimed in claim 1 including bolt member bias means arranged to bias said at least one bolt member towards an engaged position.

14. A lock mechanism as claimed in claim 1 including bolt member drive means arranged to drive said at least one bolt member between said engaged and disengaged positions.

15. A lock mechanism as claimed in claim 14 wherein said bolt member drive means comprises a first drive gear wheel engaged with a length of a first bolt member and with a length of a first side of a second bolt member, a second drive gear wheel engaged with a length of a second side of said second bolt member and with a length of a third bolt member, said first and second drive gear wheels being arranged to rotate in opposed directions in response to movement of said first or second operating members, said first and third bolt members being arranged to be driven in opposed directions by rotation of said drive gear wheels, and said second bolt member being arranged to be driven in a direction generally perpendicularly to said opposed directions.

16. A lock mechanism as claimed in claim 15 wherein said latch means includes latch operating means arranged to be responsive to movement of said first operating member to release said at least one bolt member; said latch operating means comprising a latch gear wheel and a latch member, said latch gear wheel being arranged to be responsive to movement of said first operating member to release said latch member from engagement with said at least one bolt member.

17. A lock mechanism as claimed in claim 15 wherein said latch means includes latch operating means arranged to be responsive to movement of said first operating member to release said at least one bolt member, said latch operating means comprising a latch gear wheel, and a latch operating member, said latch gear wheel being engaged with a length of said latch operating member and being arranged to rotate in response to movement of said first operating member and drive said latch operating member in a first direction, said latch means including a latch member arranged to be moveable between a latched and an unlatched position, and said latch operating member being connected to said latch member such that movement of said latch operating member in said first direction causes said latch member to move from said latched to said unlatched position.

18. A lock mechanism as claimed in claim 16 wherein said latch gear wheel and said first drive gear wheel are arranged on a common shaft, said latch gear wheel being adapted to receive said first operating member and rotate in response to movement thereof, said first drive gear wheel and said latch gear wheel being connected by lost motion means such that initial motion of said first operating member causes rotation of said latch gear wheel only until the lost motion is taken up whereupon motion of said first operating member causes rotation of said first drive gear wheel.

19. A lock mechanism as claimed in claim 18 wherein said lost motion means comprises at least one pin protruding from one of said latch gear wheel and said first drive gear wheel, and at least one slot provided in the other of said first drive gear wheel or said latch gear wheel to receive said at least one pin.

20. A lock mechanism as claimed in claim 18 including latch member bias means arranged to return said latch member to the latched position once the lost motion is given up.

21. A lock mechanism as claimed in claim 20 wherein said latch member bias means comprises spring means interconnecting said first drive gear wheel and said latch gear wheel.

22. A lock mechanism as claimed in claim 1 wherein said latch release means includes a lock member arranged to be engageable with said at least one bolt member, and a key operable mechanism for operating said lock member.

23. A lock mechanism as claimed in claim 22 wherein said latch release means includes a solenoid connected to said lock member for remote electrical operation.

24. A lock mechanism for attachment to and use on a door hinged in a door frame at a first side, said lock mechanism comprising bolt members moveable between an engaged position in a door frame and a disengaged position, said bolt members being adapted to engage such door frame from at least two of the sides of such door which are not hinged, latch means arranged to prevent movement of at least one said bolt member from said engaged position to said disengaged position, and a latch release arrangement to disengage said latch means and allow movement of said bolt members, said latch release arrangement and said bolt members being arranged to be operable in response to a single rotary movement of a single operating member, said latch means being disengaged upon initial rotation of said operating member and said bolt members subsequently being disengaged from said engaged position upon a continuation of the same rotary movement of the same single operating member, and said bolt members being arranged to be directly driven between said engaged and disengaged positions by movement of said operating member, said lock mechanism further including a first operating member for operating said bolt members and said latch release arrangement from one side of said lock mechanism, and operating means for operating said bolt members and said latch release arrangement from the other side of said lock mechanism, said operating means comprising a second operating member and latch release means, said latch release means being arranged to operate said latch release arrangement, and said bolt members being arranged to be moveable between said engaged and said disengaged positions in response to movement of said first or second operating members.

* * * * *